United States Patent [19]

Legille et al.

[11] 4,074,835

[45] Feb. 21, 1978

[54] FURNACE CHARGER WITH DISCHARGE CHANNEL HAVING APPROXIMATE OVAL CROSS-SECTION

[75] Inventors: Edouard Legille, Luxembourg; Rene N. Mahr, Howald-Hesperange, both of Luxembourg

[73] Assignee: S.A. des Anciens Etablissements Paul Wurth, Luxembourg, Luxembourg

[21] Appl. No.: 339,296

[22] Filed: Mar. 6, 1973

[30] Foreign Application Priority Data

Mar. 6, 1972 Luxembourg ..... 64909

[51] Int. Cl.[2] ..... F27B 11/12; B65D 87/28

[52] U.S. Cl. ..... 222/558; 222/575

[58] Field of Search ..... 222/504, 558, 56, 58, 222/575; 214/35 R, 2, 17 CB

[56] References Cited

U.S. PATENT DOCUMENTS

| | | | |
|---|---|---|---|
| 642,161 | 1/1900 | Sargent et al. | 222/558 |
| 1,942,617 | 1/1934 | Saurbrey | 222/558 X |
| 2,013,306 | 9/1935 | Harrington | 222/558 X |
| 2,854,171 | 9/1958 | Trief | 222/558 X |
| 3,589,670 | 6/1971 | Armstrong | 222/504 X |
| 3,693,812 | 9/1972 | Mahr et al. | 214/35 R |

FOREIGN PATENT DOCUMENTS

| | | | |
|---|---|---|---|
| 59,207 | 9/1969 | Luxembourg | 214/35 R |

*Primary Examiner*—Robert B. Reeves
*Assistant Examiner*—David A. Scherbel

[57] ABSTRACT

Apparatus including a channel defining member and a movable flow control device cooperating therewith for exercising variable control over the rate of delivery of charge material from a hopper to a furnace is disclosed. The channel defining member approximates an oval shape and the flow control device is a concave shaped member which rotates from a full open to a full closed position along the major axis of the oval and with respect to the discharge end of the channel defining member.

9 Claims, 3 Drawing Figures

FURNACE CHARGER WITH DISCHARGE CHANNEL HAVING APPROXIMATE OVAL CROSS-SECTION

BACKGROUND OF THE INVENTION

1. Field of the Invention

This invention relates to the charging of furnaces and particularly shaft furnaces. More specifically, the present invention is directed to a metering device for controlling the flow of charge material being directed unto the hearth of a blast furnace. Accordingly, the general objects of the present invention are to provide novel and improved methods and apparatus of such character.

2. Description of the Prior Art

While not limited thereto in its utility, the present invention is particularly well suited for use with a blast furnace. The construction of modern high production blast furnaces has imposed new and more stringent demands on the charging apparatus due in part to the increased internal pressures and the increased dimensions of the surface within the furnace over which the charge must be uniformly distributed. In order to obtain optimal furnace operation, it is necessary to be able to measure and excercise control over all of the operating processes both in and on the furnace. Complete economy of operation particularly requires that the furnace charging process parameters be known and controlled. The distribution and metering of the charge over the furnace cross-section is a matter of primary importance because the profile of the charge provides the basis for the control of further operating processes within the furnace. Considering the large throat cross-sections and the very high pressures and temperatures which occur at the throats of the furnaces presently in use, and taking into account the fact that the charge material may vary in composition and grain size, it will be obvious to those skilled in the art that satisfactory control over the charging process requires the metering of the flow of material into the furnace. Similarly, means must be provided which will permit the rate of flow of material to be varied at will during a charging process.

Prior to the introduction of the furnace charging apparatus disclosed and claimed in U.S. Pat. No. 3,693,812 issued Sept. 26, 1972 to R. Mahr et al, optimal uniform distribution of a furnace charge over the entire charging area was not possible. The apparatus of the referenced patent permits the exercise of control of the charging process over the complete hearth cross-section of the furnace by means of a feed chute rotatably arranged in the furance and angularly adjustable relative to the furnace axis.

U.S. applications Ser. Nos. 339,118 and 339,297, filed contemporaneously herewith, disclose apparatti wherein the weight of the charge material supplied to the furnace may be monitored during the charging process. The apparatti of copending Applications Ser. Nos. 339,118 and 339,297 permit control to be exercised over the charge material supplied to the feed and distribution chute of the apparatus of U.S. Pat. No. 3,693,812 as a function of the required charge for the furnace operating conditions.

The maximum benefits which may be realized through use of the metering apparatus of copending Application Ser. No. 339,118 can be achieved if, in addition to an accurate weight determination of the charge burden, the flow of charge material from a supply hopper to the distribution chute can be regulated by an easily controllable metering member. The conveying means employed in the prior art to transfer charge material from a supply hopper to the furnace have at best had a limited influence on the control or checking of the feeding process and serve either solely for transportation of the charge in the horizontal direction or to insure that the material will not be dropped onto the furnace hearth from too high an elevation. Typical of the prior art hopper-furnace conveying means have been discharge troughs, vibrators and screw conveyors. The movable members of the prior art conveying means are subjected to wear by the constant friction of the charged materials on their surfaces and in practice these conveying devices have had an unacceptably limited life. In the interest of increasing life, efforts have been made to clad the portions of the conveying means exposed to wear with an appropriate hard metal or artificial balsalt. These coating techniques have, however, offered only minor improvements in the operational life of the equipment. A further disadvantage of the prior art conveying means is that such apparatus has been unable to abruptly terminate the flow of charged material into the furnace thereby requiring the incorporation of an additional material stopping member. As will be obvious to those skilled in the art, increases in complexity of the charging apparatus, as for example required by separate conveying and flow shut-off means, not only increases equipment complexity and expense but also encounters space limitation and sealing problems; particularly in the case of high pressure furnaces.

SUMMARY OF THE INVENTION

The present invention overcomes the above briefly described and other deficiencies and disadvantages of the prior art by providing a reliable and precisely operable metering device for use in the control of materials being delivered to the hearth of a furnace. The apparatus in accordance with the present invention is characterized by a lack of dependency on either the nature or grain size of the charge material. The present invention is further characterized by flow control apparatus which is easily incorporated within the overall furnace charging installation and which may be incorporated within a completely automatic control for a charging process.

In accordance with the invention, a simple restrictor or shutter is inserted in the opening of a supply hopper discharge channel to thus define a precisely controllable metering member. A particularly novel feature of the invention is the fact that the cross-section of the channel opening cooperates with the metering member to maintain a particular length-to-width ratio for specific grain sizes of the out-flowing material regardless of the restrictor position. For the materials conventionally used to charge a blast furnace, favorable flow conditions and thus optimum length-to-width ratios of the cross-sections of the channel opening will result in a discharge opening or outflow channel from the supply hopper which approximates an oval shape. A restrictor inserted into this oval shaped discharge opening provides the desired length-to-width ratio in any intermediate position and test results have shown that, for the most varied charge burden components, the material flow rate is a direct function of the opening produced by the restrictor.

To summarize, in accordance with the present invention each supply hopper of a charging installation for a furnace is provided, at its lower or discharge end, with a discharge channel having a cross-section which is of approximately oval shape. The discharge opening of the channel; i.e., where the channel discharges the charge material into the means which spreads the charge on the hearth; has a closing restrictor or shutter associated therewith whereby the discharge opening of the channel can be controlled. In accordance with the disclosed preferred embodiment of the invention, the cross-section of the supply hopper discharge channel of a furnace charging apparatus has a hexagonal form thus approximating the desirable oval shape. The closing restrictor associated with the end of this octagonal chamber comprises an arcuate or helmet-shaped throttle valve or flap which may be inserted into or removed from the channel and which operates along the major axis of the generally oval shaped channel.

BRIEF DESCRIPTION OF THE DRAWING

The present invention may be better understood and its numerous objects and advantages will become apparent to those skilled in the art by reference to the accompanying drawing wherein like reference numerals refer to like elements in the several figures and in which.

DESCRIPTION OF THE PREFERRED EMBODIMENT

Figure 1:
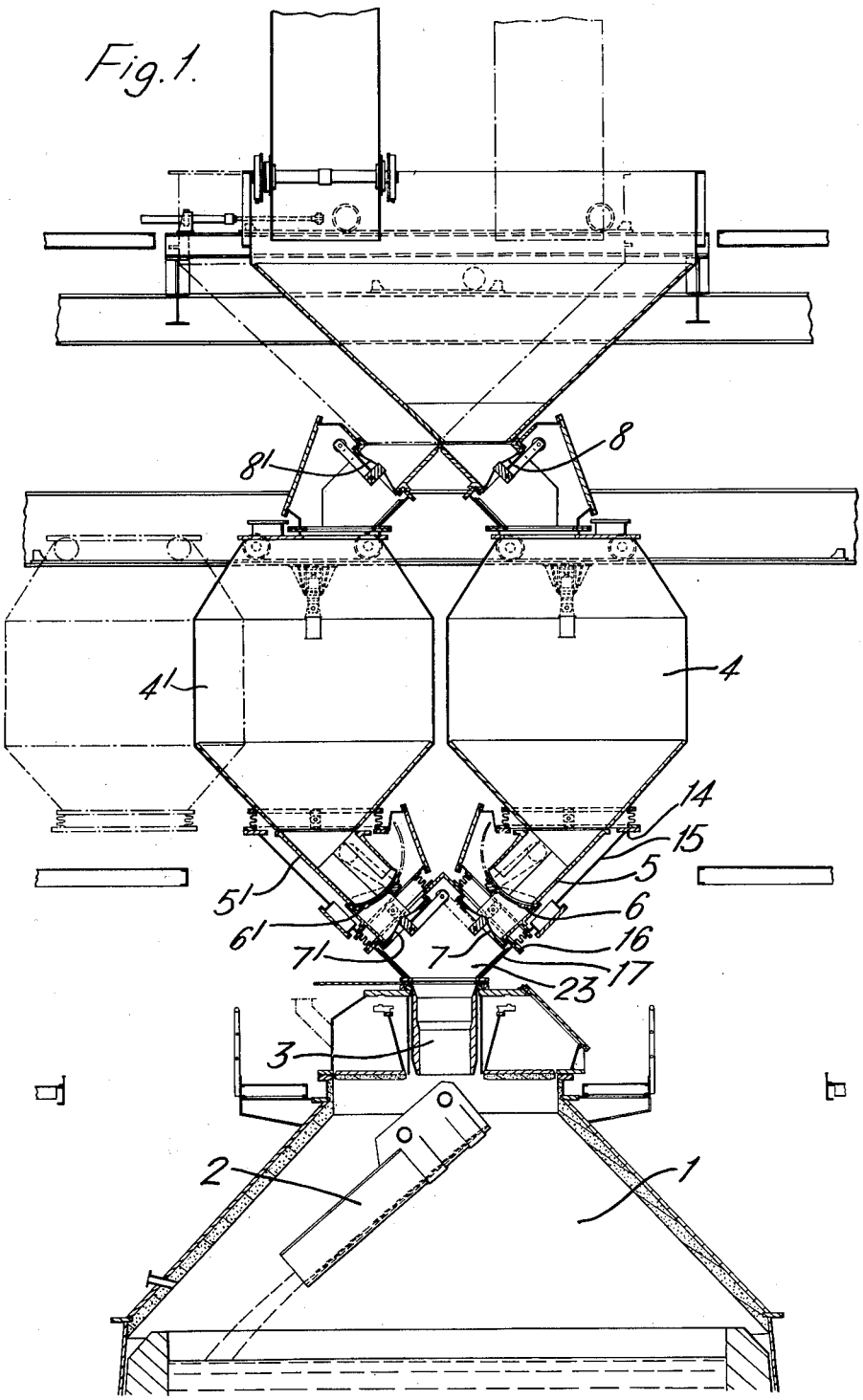
FIG. 1 is a side elevation view, partially in section, of furnace charging apparatus including the metering device of the present invention.

With reference to FIG. 1, the head of a blast furnace is indicated at 1. Furnace charging apparatus including the rotatable and angularly adjustable distribution chute 2 of referenced U.S. Pat. No. 3,693,812 is mounted in the head 1 of the furnace. Charge material is temporarily stored in a pair of supply hoppers or bunkers 4, 4'. The material is delivered to chute 2 from hoppers 4, 4' alternately via a central accumulating and feed spout 3. Each of the supply hoppers 4, 4' has, at its discharge end, a discharge channel. The discharge channels are indicated generally at 5 and 5' and are shown as having associated therewith respective throttle valves 6 and 6'.

In view of the high pressures generated during operation of the furnace, it is necessary to be able to isolate the interior of the supply hoppers 4, 4' from the ambient atmosphere. Accordingly, respective upper sealing valves 8 and 8' are located at the filler connections to the hoppers and further or lower sealing valves 7 and 7' are positioned downstream of the discharge channels 5 and 5'. Obviously, when material is being loaded into one of the supply hoppers its upper sealing valve is open and its lower sealing valve is closed whereas when material is being drawn from a hopper for the charging of the furnace the upper sealing valve is closed, thereby preventing an escape of the high pressure furnace waste gases, and the lower valve open. The sealing valves 7, 7' and 8, 8' are designed such that, in the opened condition, the sealing surfaces thereof are removed from the path of material flow so as to prevent the erosion thereof by the charge material.

In accordance with the present invention the lower sealing valves 7, 7' are not employed to control the flow of material and perform no charge material flow stopping function. Thus, since the sealing valves 7, 7' perform only a sealing function and the sealing surfaces thereof at no time contact moving charged material, long lasting proper operation of these valves is obtained.

In operation, when material is to be discharged into the furnace from one of the supply hoppers, the upper sealing valve 8 associated with the selected hopper is closed and the pressure within the supply hopper equalized with that within the furnace throat in the manner well known in the art. After the pressure has been equalized, the lower sealing valve can be easily opened. When the lower sealing valve 7 has been removed completely from the material flow path, the throttle valve 6 is opened and the charge material released from the supply hopper 4 via discharge channel 5 and delivered to chute 2 via spout 3.

Referring now jointly to FIFS. 2 and 3, the supply hopper 4 has associated therewith a discharge channel 5. The throttle valve member 6 is positioned at the lower or discharge end of channel 5 and, in the disclosed embodiment, has an arcuate or helmet-shape cross-section; i.e., the valve member 6 has a concave cross-section with respect to the direction of flow of material discharging from hopper 4. The throttle valve member 6 serves to brake or restrict the flow of material from hopper 4 upon insertion of member 6 into the discharge opening 9 defined by the lower end of channel 5 in the manner to be described below. The arcuate shape of throttle valve member 6 is dictated by the interest of minimizing the forces necessary for opening and closing the valve. Since only the nose or leading edge 10 of throttle valve member 6 is subjected to wear by moving charged material flowing there against, this portion of member 6 is made of increased thickness. Also, since throttle valve member 6 performs no sealing function, either the entire member 6 or the forward portion 10 thereof may be made from a hard metal in the interest of minimizing valve member wear.

Figure 2:
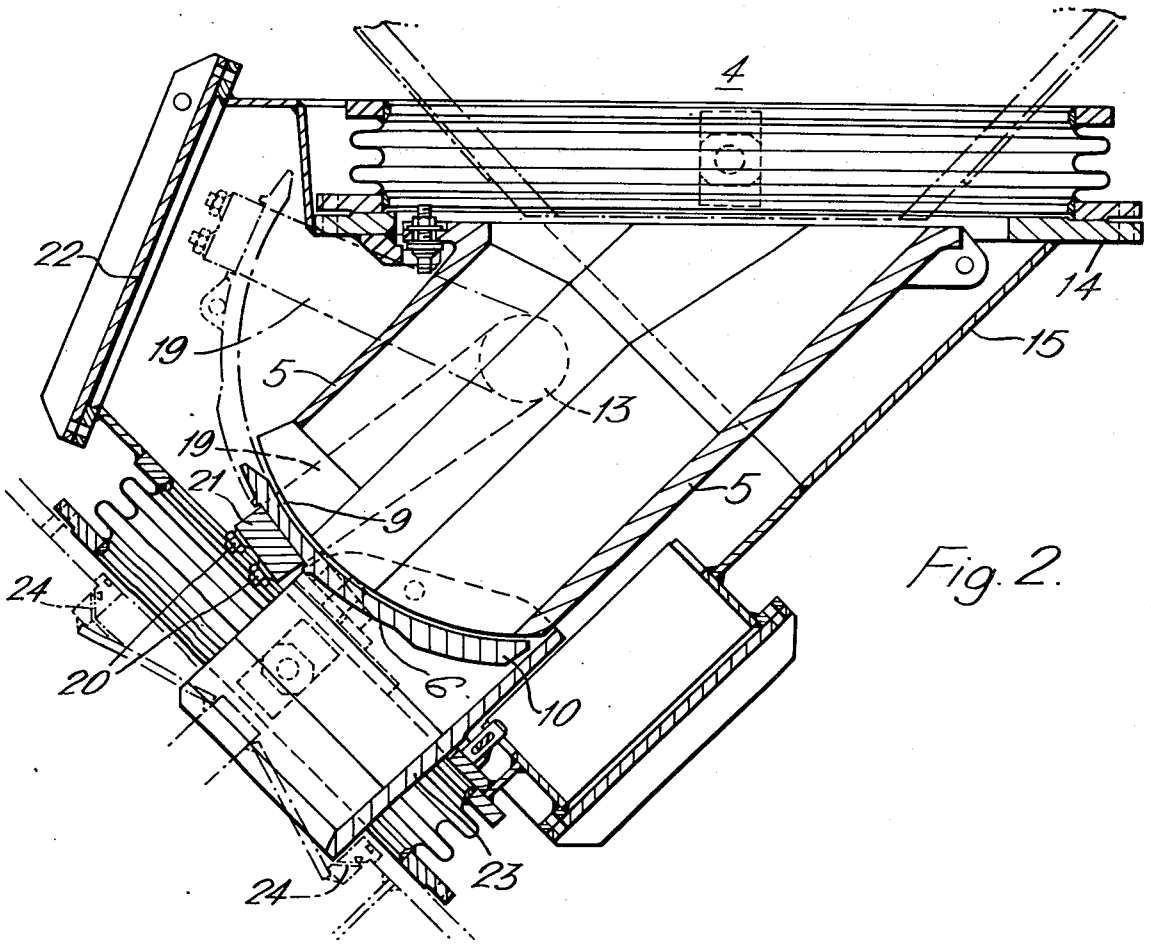
FIG. 2 is an enlarged cross-sectional view of the metering device of the present invention.
Figure 3:
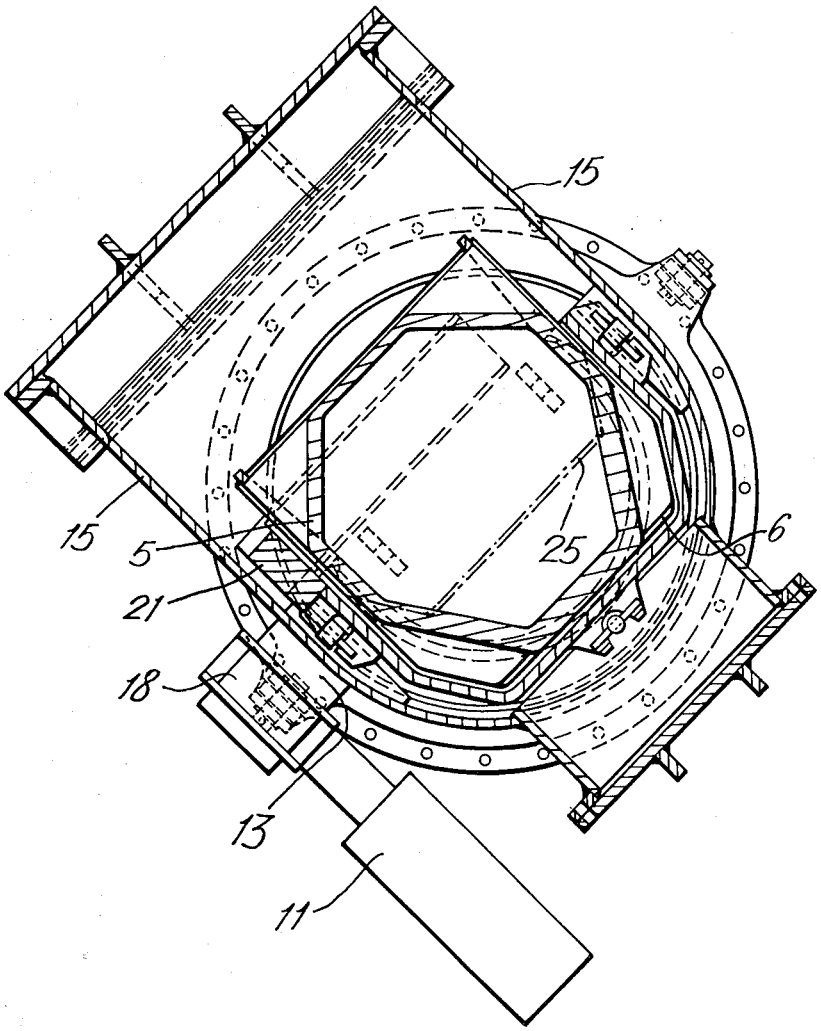
FIG. 3 is a cross-sectional view taken along the discharge channel of a supply hopper in accordance with the present invention.

As may best be seen from FIG. 3, the supply hopper discharge channel 5 has a octagonal cross-section in the preferred embodiment; i.e., in the preferred embodiment the shape of the discharge channel approximates the preferable oval shape. The means by which discharge channel 5 is mounted from supply hopper 4 can be seen from a joint consideration of all of FIGS. 1–3. The channel 55 is connected to supply hopper 4 via a mounting flange 14 and is surrounded by a protective casing 15. Casing 15 is also connected to the lower portion of hopper 4 via flange mounting 14. At its lower end the casing 15 is connected, via a further mounting flange 16, to spout 3 by means of connecting member 17 mounting flange 16 and connecting member 17 being indicated on FIG. 1.

The throttle valve member 6 is moved via pivotally mounted lever means. The power for imparting movement to the valve is provided by an actuator 11 (FIG. 3). The actuator 11 may be a hydraulic cylinder or an electric drive. As may be seen from joint consideration of FIGS. 2 amd 3, a first arm 18 of the lever means is positioned externally of the casing 15 and is connected at one end to a longitudinally movable output member of actuator 11. The other end of arm 18 is rigidly connected to a pivot member 13. The pivot member 13 passes through the wall of the casing 15 and operates a second arm 19 of the lever means; lever arm 19 being positioned between discharge channel 5 and casing 15. A first end of lever means arm 19 is rigidly connected to pivot 13 in the space between channel 5 and casing 15 and the second or free end of arm 19 is connected by means of screw connections 20 to the trailing edge of the throttle valve member 6 via a union 21. Pivot 13 passes through the casing 15 in a manner well known in the art; i.e., the passage of the pivot through the channel is sealed by stuffing box packings; whereby a gas tight connection is provided. All the drive members for throttle valve member 6 are located outside of the path of flow of charge material being delivered from hopper 4 to the furnace.

Considering, by way of example only, the throttle valve drive 11 to comprise a hydraulic cylinder, reference to FIG. 2 will show that the throttle valve member 6 is operated in the "open" direction as the piston rod associated with the drive is extended. The casing 15 is designed in such a manner that, as may be seen from the broken line in FIG. 2, the throttle valve member 6 can be removed completely out of registration with the discharge end 9 of channel 5. The casing 15 is provided with a hatch 22 which permits the disassembly and replacement of the throttle valve 6 when the valve has been driven to the full open position and the lower sealing valve 7 closed.

Referring again jointly to FIGS. 1 and 2, a guide channel 23 provides flow guidance between the end 9 of discharge channel 5 and the upper end of the spout 3. The upper end of the guide channel defining member 23 also defines the sealing surfaces 24 of the lower sealing valve 7. It may best be seen from FIG. 2, the sealing surfaces 24 are all located on the outer wall of the guide channel 23 thereby insuring that these surfaces will be out of the path of flow of charge material being delivered to the furnace.

As may be seen from joint consideration of FIGS. 2 and 3, the three sides of the discharge channel 5 which are subjected to the maximum wear are made somewhat thicker than the other sides of the channel. In FIG. 3 the throttle valve member 6 is shown in an intermediate position wherein the leading edge 10 thereof is indicated by the broken line 25. FIG. 3 also clearly shows that the valve member 6 operates along the major or longer axis of the oval approximated by the side sections of discharge channel 5.

Flow tests have shown that for a previously screened raw material having a grain size range within specified limits, the time required for a particular quantity of such material to flow through a channel designed and controlled in accordance with the present invention will always be the same and will be a function of control valve position. Restated, in order to insure that a predetermined quantity of material discharges during a given time, the metering valve member 6 may be brought into a particular intermediate position, hereinafter called the "average" position, which will be predetermined by tests or calculations for each type of charge material and each average grain size. Thus, for each charge material type and each grain size, a particular "average" valve position will be commensurate with discharge time for a known quantity of material. Thus, if charging is to take place with a constant rotational speed of the distribution chute 2, use of the metering valve and discharge channel of the present invention permits the same quantity of charge material to always be supplied to the chute per unit of time leading to a uniform discharge as the chute rotates. By means of a simple rotational movement the metering valve member 6 can be moved relatively quickly from one position to another and thus the present invention is particularly well suited for performing corrections during the charging process. Such corrections or readjustment in the position of the metering valve member from its "average" position can be commanded by signals emanating from a continuous weight measurement.

In addition to its above-described metering function, the valve member 6 of the present invention may also function as a stop valve permitting an abrupt interruption of the flow of material to the furnace.

Due to its uncomplicated design, the apparatus of the present invention is less expensive and less susceptible to operational failure than any prior art devices of similar character and the present invention thus represents a substantial improvement in the control of blast furnace operations.

As noted, use of a discharge channel which approximates an oval cross-section is preferable in the interest of obtaining an approximately constant materal flow per unit of time for different charge burden components and grain sizes.

While a preferred embodiment has been shown and described, various modifications and substitutions may be made thereto without departing from the spirit and scope of the invention. Accordingly, it is to be understood that the present invention has been described by way of illustration and not limitation.

What is claimed is:

1. In apparatus for use in the charging of a furnace, the charging apparatus including a storage hopper from which materials will be released for delivery into the furnace, the improvement comprising:

discharge channel defining means, said channel defining means including a plurality of straight wall portions, said straight wall portions cooperating to form a tubular element having a longitudinal axis and being open at its opposite ends, said tubular element having a cross-sectional shape when viewed along said longitudinal axis which approximates an oval, said approximately oval cross-section having a major axis and a transverse minor axis, said channel defining means being connected at a first upstream end to the storage hopper;

a movable throttle valve member juxtapositioned to the second downstream end of said channel defining means, said valve member having a leading edge portion and being supported for movement of said leading edge portion along a path transverse to a plane including the longitudinal axis of said tubular element and extending through the major axis of said approximately oval shaped tubular element whereby said valve member will cooperate with the second end of said channel defining means to form an adjustable discharge opening to vary the flow rate through said channel defining means, said discharge channel flow rate being variable about a valve member position intermediate the full open and full closed positions and directly with the size of said discharge opening and as a function of composition and average grain size of the material flowing through the channel, there being a different valve position required to obtain a preselected average flow rate for different combinations of material composition and average grain size;

means for delivering material passed by said throttle valve member to the interior of the furnace;

substantially hermetic casing means at least in part surrounding said discharge channel defining means and said throttle valve member;

sealing valve means positioned within said hermetic casing means intermediate said throttle valve and said means for delivering material into the furnace, said sealing valve means cooperating with said casing means to permit said throttle valve member and the intermediate storage hopper to be isolated from the conditions existing within the furnace;

actuator means; and means coupling said actuator means to said throttle valve member to cause the repositioning of said valve member leading edge portion to vary the discharge opening defined by the second end of said channel defining means tubular element and said valve member.

2. The apparatus of claim 1 wherein said discharge channel defining means has at least six straight wall portions.

3. The apparatus of claim 2 wherein said discharge channel defining means tubular element has an octagonal shape.

4. The apparatus of claim 1 wherein said throttle valve member presents a generally concave surface contour to said second end of said channel defining means.

5. The apparatus of claim 1 wherein said actuator is positioned externally of said casing means and wherein said coupling means comprises:

pivot means extending through said casing means; and means positioned between said casing means and said discharge channel defining means for coupling movements of said pivot means to said valve member.

6. The apparatus of claim 1 wherein said valve member leading edge portion is of increased thickness with respect to the remaining portions thereof.

7. The apparatus of claim 6 wherein said discharge channel defining means tubular element has an octagonal shape.

8. The apparatus of claim 7 wherein said actuator means is positioned externally of said casing means wherein said coupling means comprises:

pivot means extending through said casing means; and means positioned between said casing means and said discharge channel defining means tubular element for coupling movements of said pivot means to said valve member.

9. The apparatus of claim 8 wherein said throttle valve member presents a generally concave surface contour to said second end of said channel defining means.

* * * * *